US006887116B2

(12) United States Patent
Saguciо

(10) Patent No.: US 6,887,116 B2
(45) Date of Patent: May 3, 2005

(54) WATERCYCLE FOR WET RIDER

(76) Inventor: Esteban N. Saguciо, 201 Wailea Ct., Roseville, CA (US) 95747

( * ) Notice: Subject to any disclaimer, the term of this patent is extended or adjusted under 35 U.S.C. 154(b) by 0 days.

(21) Appl. No.: 10/855,232

(22) Filed: May 17, 2004

(65) Prior Publication Data

US 2004/0224578 A1 Nov. 11, 2004

Related U.S. Application Data

(63) Continuation-in-part of application No. 10/392,811, filed on Mar. 21, 2003, now abandoned.

(51) Int. Cl.[7] ..... B63H 16/20
(52) U.S. Cl. ..... 440/26; 440/31
(58) Field of Search ..... 440/21, 26–31, 440/12.62–12.7

(56) References Cited

U.S. PATENT DOCUMENTS 1,610,778 A * 12/1926 Erasmus ..... 440/31
2,752,617 A * 7/1956 Fowler et al. ..... 440/31
2,983,245 A * 5/1961 Ambrose ..... 440/31
5,081,947 A * 1/1992 Holden ..... 114/345

FOREIGN PATENT DOCUMENTS

GB 2118506 A * 11/1983

* cited by examiner

*Primary Examiner*—Jesus D. Sotelo

(57) ABSTRACT

A watercycle having, generally do-nut shape float mounted onto a frame or chassis member, and a rider's seat within the hollow of the float and which can be adjusted vertically and horizontally. Adjusting the seat to its highest level will cause the seated rider to submerge up to the hip, and adjusting it to its lowest level will cause the rider to submerge up to the chest. The seat is likewise adjustable forward and backward for convenient foot-reach to the pedals. The watercycle is fitted with steerable propellers utilizable for propelling and for steering.

5 Claims, 4 Drawing Sheets

FIG.5
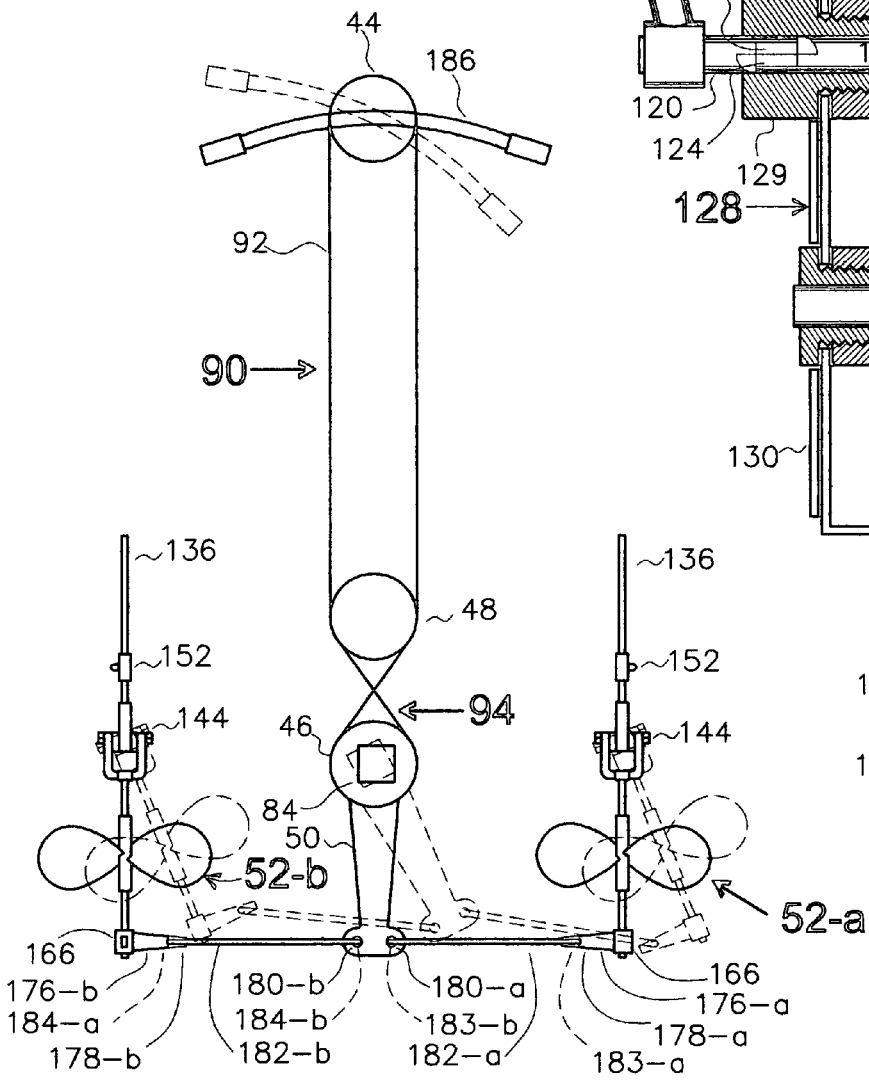
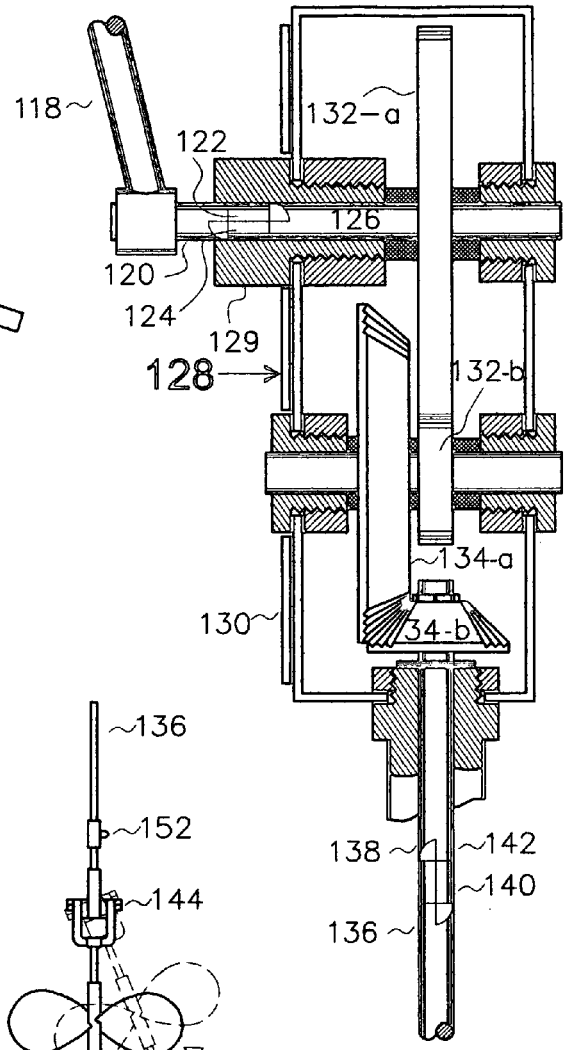
FIG.7

WATERCYCLE FOR WET RIDER

This application is a Continuation-in-Part of Ser. No. 10/392,811 filed Mar. 21, 2003, now abandoned.

FIELD OF THE INVENTION

The present invention relates generally to small leisure equipment in the water and more particularly to a watercycle wherein portion of the body of a rider, below the head, is underwater. The novel watercycle includes propellers for propulsion and is moved by working pedals. The propeller units can swivel sidewise and thus it can also be utilized to steer the watercycle.

THE PRIOR ART

The background art seems to have a distant relevance to the present invention. In fact there's no known prior art watercycle that includes a seat that's adjustable horizontally in order for riders of different sizes to conveniently reach the pedals with the feet. Also, there's no prior art watercycle with a seat that's adjustable vertically to make it possible for a rider to obtain a desired body submergence when the watercycle is floated in the water.

Prior art watercycle assemblies including float, seat, pedals and propellers are disclosed by Helm, U.S. Pat. No. 1,610,778; Fowler, U.S. Pat. No. 2,752,617 and Ambrose, U.S. Pat. No. 2,983,245 are all meant for a rider to get wet while having leisure in the water. These watercycles mentioned above don't have vertically and horizontally adjustable seat respectively for desired submergence depth and for the right distance of the feet to the pedals. No runner is provided to give protection of the equipment on the ground or on the beach. Holden, U.S. Pat. No. 5,081,947 disclosed a boat assembly with "dry seat", no runner nor sort of protection for the propeller and rudder is provided while on the ground.

SUMMARY OF THE INVENTION

It is the primary object of the present invention to provide a watercycle that will keep a rider in wet condition.

Another object is to provide a rider the choice of how much of the lower body is submerged by adjusting the seat closer to or further below the water surface when the watercycle is floated.

Yet another object is to provide a safety vehicle for a non-swimmer who desires to have leisure or simply cooling off in deeper water.

Still another object is to provide a relatively slow-moving fun ride watercraft suitable in a tight and crowded environment.

Another added object is to provide a medical equipment for one needing hydrotherapeutic treatment.

The invention is directed to small craft and more particularly to a watercycle wherein a seated rider is within the hold of a substantially do-nut shape, bottomless float, and wherein the lower portion of the body is underwater. The watercycle includes an adjustable seat so it can be moved closer to or further below the waterline for selective submergence between the hip and chest areas of a rider. The seat is likewise adjustable forward and backward for convenient reach to the pedals.

The basic concept of the invention is to provide bathers, especially youth and children, with slow-moving fun ride.

The watercycle is best used in calm and protected waters like for example, in a swimming pool, beach resort and waterpark.

In accordance with the primary aspect of the invention, the watercycle of the type includes a hollow, bottomless float mounted and secured onto a chassis or frame having a pair of runners for resting on the ground, and an elevated portion for attaching the float. Located about centrally parallel between the runners and the elevated portions is a twin beam for supporting the seat and steering mechanisms.

In the embodiment, the propeller units are each located between the runner and the elevated portions in the proximity of the downwardly bent rear end of the elevated portion. Each propeller unit is linked with the pedal unit by respective gearbox, main propeller shaft and a universal joint.

THE DRAWINGS

FIG. 5 is a schematic, in top view, of the steering mechanism for translating rotation from handlebar to steerable propeller units.

FIG. 7 shows the inside, top view, of the right-side gearbox unit employed with the present invention, numeral "7" of FIG. 3.

DESCRIPTION OF THE INVENTION

Figure 1:
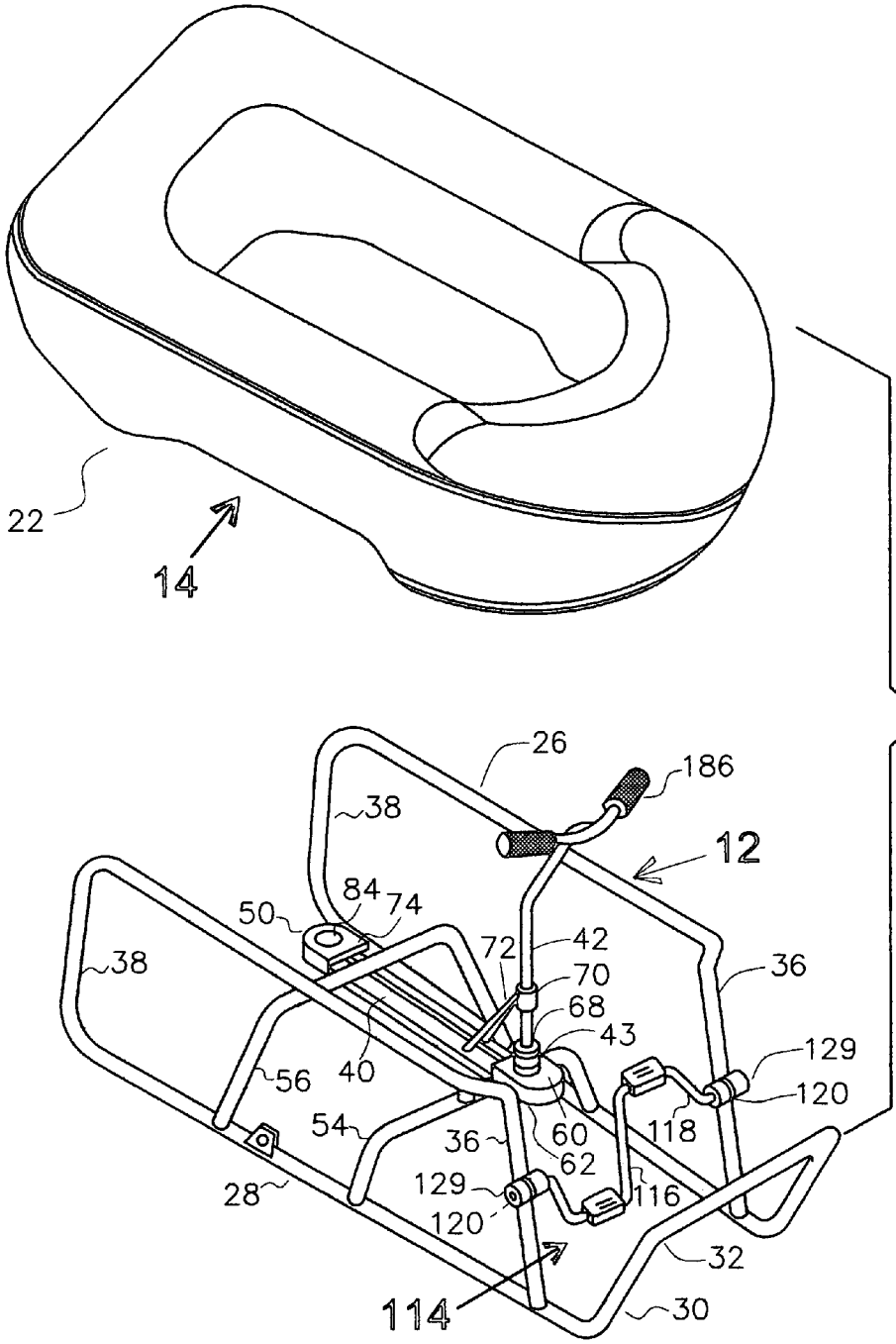
FIG. 1 is a perspective, in exploded view, of the chassis or frame and the float of the watercycle.
Figure 2:
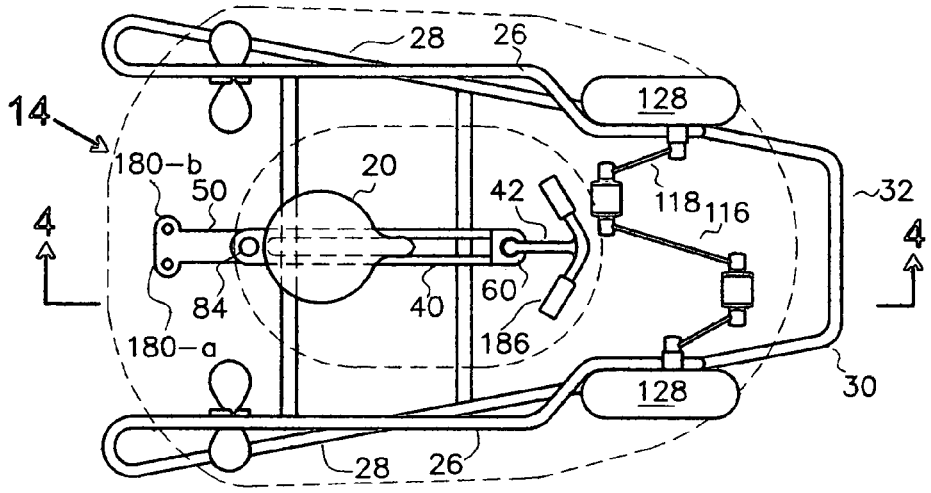
FIG. 2 is a top view of the watercycle, with the float shown in broken line.

Referring now to the drawings in greater detail, FIG. 1 shows in exploded view a chassis or frame 12 and a float 14 employed in the novel watercycle. The float 14 is generally do-nut shape, made of expanded or cellular plastic and provided with protective skin to shield from damage which may be caused by weather, rough handling or impact with hard objects. Inflatable rubber or plastic or any other selected from highly buoyant material may also be used. Underneath the front end of the float 14 is a longitudinally oriented concave portion 16 to provide sufficient room for the knees of a pedaling rider 18 like for example when the seat 20 is at higher and/or forward adjustments.

An underside bulge 22 rearward of the float is provided. The bulge is adapted to displace additional volume of water in the rear portion and thereby become a buoyant booster for that portion of the watercycle wherein more weight is anticipated. Channels 24 (not shown) are provided in the region of the underside bulge 22 to accommodate the elevated members 26 of the frame when mounting the float.

The frame 12 shown in FIG. 1 includes two generally parallel runners 28 with front ends 30 bent diagonally upwardly and joined together by a transverse member 32, for resting the watercycle on solid surface. Two generally parallel elevated members 26 are provided for suitably mounting the float thereto. The front ends 36 are bent downwardly, each connecting a respective runner 28 immediately after the upwardly bent portion 30. The rear ends 38 of the elevated members 26 are likewise bent downwardly and each connecting a respective rear end of the runners. The frame 12 is preferably of metal tubing, closed-end in order to provide strength and added buoyancy.

A horizontal twin beam 40 is provided about midway between the runners 28 and the elevated members 26, for supporting the handlebar column 42, rider's seat 20, plurality of pulleys 44, 46 and 48 therealong underneath and a swivel arm 50 for the steerable propeller units 52-*a* and 52-*b*. A front arch 54 and a rear arch 56 are welded transversely apart at their ends along the length of the runners. The front arch 54, with an upstanding riser 58 welded on top, supports the twin beam on its forward end. The rear portion of the twin beam 40 is welded crosswise underneath the upper portion of the rear arch 56, for support.

Upper and lower plates 60 and 62 respectively are fixedly attached opposed the front end of the twin beam adapted to support a handlebar column 42. A bushing or plain bearing 43 is affixed tight through the holes 64 and 66 (not shown) on the plates 60 and 62 for rotatably mounting the handlebar column 42. A retainer collar 68 is secured to the handlebar column immediately above the plain bearing 43 to keep the handlebar column from sliding down. At a convenient distance above the collar 68 is a rather loose sleeve 70 with support braces 72 as shown, provide strength to the steering column. On the rear end of the twin beam 40 is welded with another pair of opposed upper and lower plates 74 and 76. A plain bearing 78 is likewise affixed tight through openings 80 and 82 (not shown) on plates 74 and 76 for rotatably mounting the shaft portion 84 of swivel arm 50. Fixedly attached to the bottom end of the handlebar column 42 (FIG. 4) is a front or first pulley 44, and at about mid-portion of the swivel arm shaft 84 is also attached with a rear or second pulley 46. A center or third pulley 48 is rotatably mounted underside a plate 88 welded underneath the twin beam.

FIG. 5 shows in schematic an operative hitching of an endless actuating cord 90 onto the pulleys 44, 46 and 48 for translating steering movement from handlebar to the steerable propeller units 52-*a* and 52-*b*. The cord's front segment 92, between the front and center pulleys 44 and 48, are hitched in parallel, while the cord's rear portion 94, between the center and rear pulleys 48 and 46 respectively are crossed in figure "8" pattern. Thus, when the handlebar, and hence the front pulley 44, is rotated in one direction for example, the rear pulleys 46 including the shafted swivel arm 50 will rotate in the opposite direction, as shown.

Figure 6:
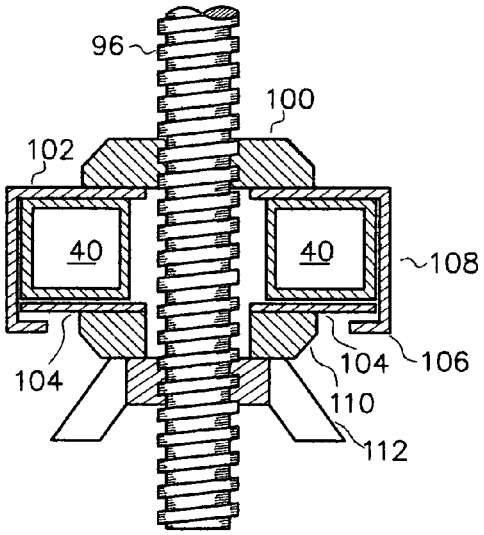
FIG. 6 is a seat adjusting mechanism taken along line 6—6 of FIG. 4.

The rider's seat 20 is rigidly affixed atop a threaded seat post 96 and is adjustable vertically for desired submergence of a seated rider. Likewise, the seat is adjustable horizontally for convenient foot-reach to the pedals 98. A mechanism for adjusting the seat vertically and/or horizontally is shown in FIG. 6, taken along line 6—6 of FIG. 4. The seat post 96 is threadably mounted to cooperating nut 100 connected fixed to a slidable base plate 102 that straddles along the twin beam 40. A clamping plate 104 with large center opening is loosely positioned below the twin beam and being supported by flanges 106 of the guide portion 108 of the base plate 102. A spacer 110 with large center opening is welded to the underneath of the clamping plate 104. A wing nut 112 is threadably connected to the lower portion of the seat post 96 below spacer 110.

To adjust the seat 20 either vertically or horizontally, or both, is to first loosen the wing nut 112 until the clamping plate 104 drop down fully to about one-eight inch and thereby loosen its grip against the underside of the twin beam 40. The slidable base plate 102 (and thus the seat post) is then moved forward or backward for convenient pedalling distance to the pedals 98. And, to adjust the seat vertically, the seat, and thus the seat post, is appropriately rotated until the right height for desired submergence of the rider is obtained. Finally, the wing nut 112 is tightened to secure the seat from wobbling.

Shown better in FIG. 1 is a pedal unit 114 which includes a jointer 116 and cranks 118 with outwardly extending shafts 120 (see FIG. 7) on either ends and having a common axis, is utilized with this concept. The extended shafts 120 include coupling jaws 122 for connection with corresponding jaws 124 on an input shaft 126 located in a gearbox unit 128. The coupled extended shafts 120 of the pedal unit and the input shafts 126 of the gearbox unit 128 is journalled in plain bearing 129. The gearbox unit 128 is suitably mounted onto a support bracket 130 welded to the intermediate of the downwardly bent front ends 36 of the elevated member of the frame 12.

The gearbox unit 128, shown in FIG. 7, is adapted to transform a relatively low rpm input from the pedal unit 114 into much higher rpm output for the propeller units 52-*a* and 52-*b*. It includes a gear train utilizing a pair of spur gears 132-*a* and 132-*b* and a pair of bevel gears 134-*a* and 134-*b*, with respective ratios. Other gearing combinations familiar in the art of gearbox designed may also be used.

Figure 3:
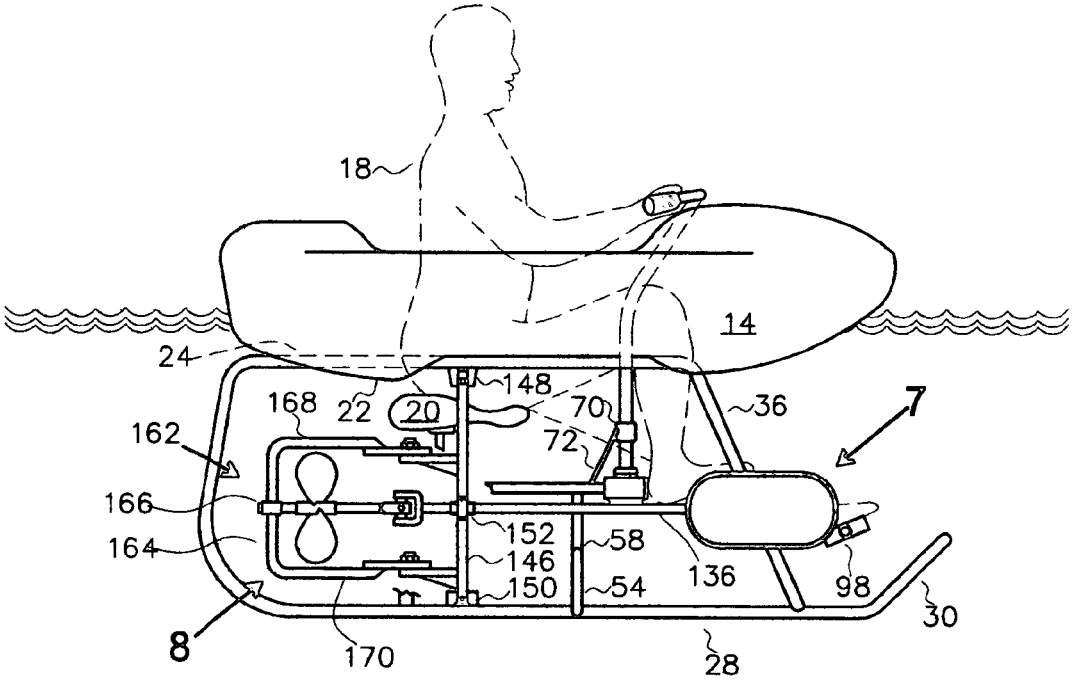
FIG. 3 shows the right side elevational view of the watercycle shown in FIG. 2.

Conventional design propeller is employed to propel the watercycle of the present invention. One propeller unit is shown mounted on each side, however, any other setup may be incorporated. The front end of a main propulsion shaft 136 is connected, by use of coupling jaws 138, to corresponding jaws 140 on the output shaft 142 of the gearbox unit 128, as shown in FIGS. 3 and 7. A universal joint 144 each interpose the propeller units 52-*a* and 52-*b* and the propulsion shafts 136, seen better in FIGS. 3 and 5.

An upright post 146 (FIG. 3) is connected in any suitable means, on its top and bottom ends, to lugs 148 and 150 welded intermediate the elevated member 26 and the runner 28 respectively. A plain bearings 152 is positioned about mid-point of the post 146 for rotatably supporting the propeller main shaft 136 on its rear portion thereof. Extended pivotal arms 154 and 156, each with upright pivot pin 158 and 160, are attached rigidly to post 146.

Figure 4:
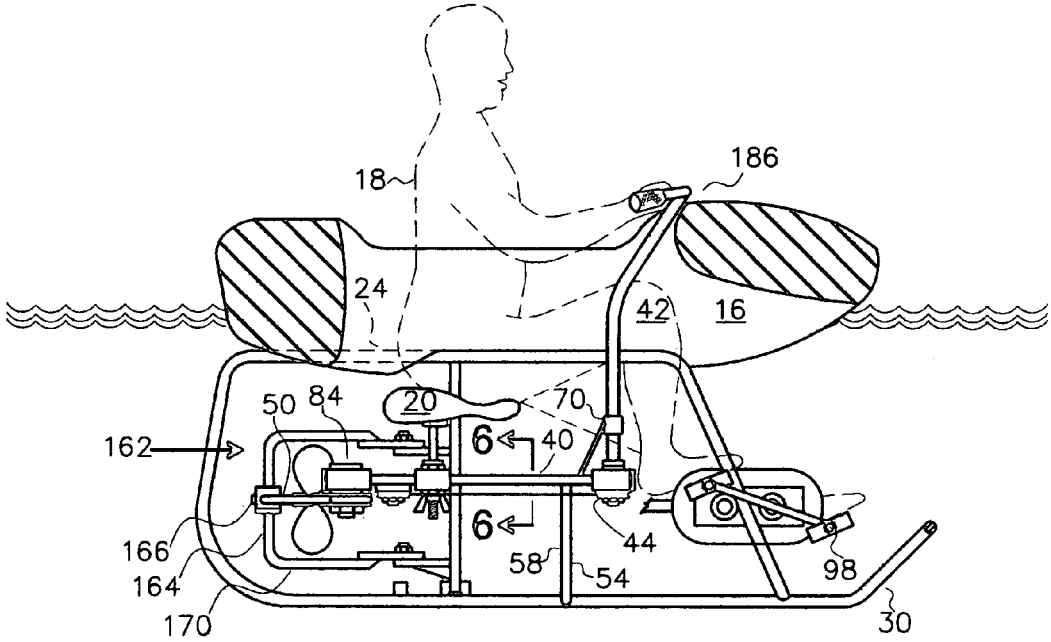
FIG. 4 shows a right elevational view of the watercycle taken substantially along line 44 of FIG. 2.
Figure 8:
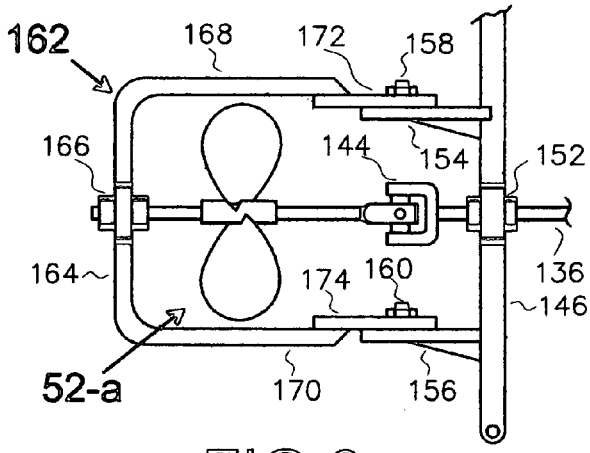
FIG. 8 is an enlarged drawing of the C-frame and associated parts, indicated by numeral "8" of FIG. 3.

In FIGS. 3, 4 and 8 is shown a C-frame 162 provided to support the propeller unit 52. The C-frame is swivelable such that the supported propeller unit can swing sidewise to a certain extent. The vertical leg 164 of the C-frame is fitted with bearing 166 to rotatably support the rear end of the propeller unit. On the ends of the upper and lower horizontal legs 168 and 170 of the C-frame are lugs 172 and 174 with openings (not shown) for receiving pivotal pins 158 and 160. The universal joint 144 and the pivotal pins 158 and 160 are aligned perfectly vertically, as viewed in FIGS. 3 and 8.

Shown in FIG. 5, lugs 176-*a* and 176-*b* are welded horizontally inwardly to the vertical leg 164 of the C-frame in the vicinity of bearing 166, (see also FIG. 3). Lugs 176-*a* and 176-*b* have each an opening 178-*a* and 176-*b* of size on their free ends. The swivel arm 50, located between propeller units 52-*a* and 52-*b*, includes adjacent openings 180-*a* and 180-*b* on its free end. Links rods 182-*a* and 182-*b* have on their respective end portions a bend of about 90-degrees. The outboard bent end 183-*a* (not shown) of link rod 182-*a* is inserted through opening 178-*a*, while its inboard bent end 183-*b* (not shown) is inserted through opening 180-*a*. Similarly, the outboard bent end 184-*a* (not shown) of link rod 182-*b* is inserted through opening 178-*b*, while its inboard bent end 184-*b* (not shown) is inserted through opening 180-*b*. It is evident therefore that any steering movement initiated on the handlebar is imparted onto the interlinked propeller units 52-*a* and 52-*b*.

To better understand the steering operation of the watercycle, when a pedalling rider wants to steer to the right for example, the handlebar 186 is rotated clockwise as shown by dotted lines in FIG. 5. With the operative hitching arrangement of pulleys 44, 46, and 48 and including the cord 90 as has been earlier discussed, the swivel arm shaft 188 will rotate counter-clockwise and will cause the swivel arm 50 and including the interlinked swivelable or steerable propellers 52-*a* and 52-*b* to assume their new positions shown by dotted lines. Hence, the rear end of the forwarding watercycle tends to swing to the left side and thereby will cause the forward end of the craft an apparent turn to the right. Oppositely, to steer the watercycle to the left for example, the operation is a complete reversal of the above example just discussed.

The embodiment having been described, changes in shape and form may be incorporated by those skilled in the art and such may be within the spirit and scope of the invention as defined by the claim herein appended.

What I claim is:

1. A watercycle wherein portion of the body of a rider, below the head is underwater comprising:

a)a frame including a pair of substantially parallel runners for resting said watercycle on a solid surface and having on the front ends thereof upwardly bent portion and being connected together by a transverse member, and a pair of elevated, substantially parallel portions with front ends bent downwardly and connecting said runners immediately behind said upwardly bent portions, and the rear ends of said elevated portions bent downwardly and connecting the rear ends of said runners b) a generally do-nut shape, highly buoyant float member suitably mounted onto said frame for floating said watercycle and said rider thereof;

c)twin beam disposed longitudinally horizontally between said pair of runners and pair of elevated portions, said twin beam for supporting a rider's seat, steering column and swivel arm thereof;

d) plurality of arches connected transversely apart along the intermediate portion of said pair of runners, for supporting said twin beam;

e) a seat supported by said twin beam adjustable vertically for desired submergence depth of a rider in the water, and horizontally by suitably sliding said seat along said twin beam for convenient reach to the pedals, said seat adjustable vertically by appropriately rotating thereof;

f) plurality of pulleys including first and second pulleys fixedly attached respectively to the lower portions of said steering column and said swivel arm, and further including a third pulley disposed rotatably underneath said twin beam between said first and second pulleys, said swivel arm being connected to a swivelable C-frame supporting said propeller unit, by linkage rod thereof;

g) a pedal unit having shaft on either side extended outwardly and rotatably supported intermediate the downwardly bent front ends of said elevated portion, said pedal unit shaft adapted to communicate with means transforming a relatively low rpm pedal unit input into higher rpm propeller unit output;

h) propeller unit means mounted and arranged for propelling and for steering said watercycle;

i) means translating steering movement from handlebar to steerable propeller unit includes hitching of actuating cord having its front portion between said first and third pulleys hitched in parallel pattern, and the rear portion of said cord between said second and third pulleys hitched in figure "8" pattern whereby when the handlebar is manipulated for steering the watercycle, said swivel arm will inapart swivel movement to said propeller unit by actuation of said linkage rod.

2. The float recited in claim 1 further include a longitudinally oriented concave portion underside the front end thereof, to provide sufficient room for the knees of a pedaling rider, and plurality of channels in the region of an underside bulge adapted to accommodate the rear portion of said elevated portion of the frame when the float is mounted onto said frame.

3. The seat recited in claim 1 further comprising;

a) a threaded seat post rotatably connected to a cooperating nut affixed to a base plate, said base plate being supported slidably by said twin beam;

b) spacer means rigidly attached underneath a clamping plate, said clamping plate for clamping against the underside of said twin beam;

c) a wing nut threadably connected to the lower portion of said seat post underneath said spacer means, whereby, when said wing nut is rotated in one direction, it will cause the clamping plate to ease off its grip against said twin beam, and when said wing nut is rotated in the other direction, it will cause said clamping plate to apply its grip against twin beam and thus prevent said seat from wobbling.

4. The invention of claim 1 wherein said means transforming a relatively low rpm pedal input into higher rpm propeller output is a gearbox unit having an input shaft in communication with said pedal unit shaft, and an output shaft in communication with the front end of a propeller main shaft, said gearbox unit having a pair of ratio spur gears and a pair of ratio bevel gears.

5. The invention of claim 1 wherein said C-frame supporting said propeller unit includes plurality of pivotal pins vertically aligned with a universal joint interposed said propeller unit and said propeller main shaft, and thereby permitting sidewise swivel movement of said C-frame including said propeller unit.

* * * * *